US008091494B2

(12) United States Patent
Nikolajsen et al.

(10) Patent No.: US 8,091,494 B2
(45) Date of Patent: Jan. 10, 2012

(54) LIQUEFIED GAS TANK WITH A CENTRAL HUB IN THE BOTTOM STRUCTURE

(75) Inventors: Carsten Stanley Nikolajsen, Tonsberg (NO); Hans Hakon Norr, Notteroy (NO)

(73) Assignee: NLI Innovation AS, Vear (NO)

( * ) Notice: Subject to any disclaimer, the term of this patent is extended or adjusted under 35 U.S.C. 154(b) by 0 days.

(21) Appl. No.: 12/314,030

(22) Filed: Dec. 3, 2008

(65) Prior Publication Data

US 2009/0199760 A1 Aug. 13, 2009

Related U.S. Application Data

(60) Provisional application No. 60/996,722, filed on Dec. 3, 2007.

(51) Int. Cl.
*B63B 25/08* (2006.01)

(52) U.S. Cl. ..... 114/74 A; 220/560.11

(58) Field of Classification Search ..... 114/65 R, 114/74 A; 220/560.04, 560.07, 560.08, 560.11, 220/560.12, 560.03, 560.05, 560.09
See application file for complete search history.

(56) References Cited

U.S. PATENT DOCUMENTS 2,451,486 A * 10/1948 Horton ..... 220/560.08
3,766,876 A * 10/1973 Cowles ..... 114/74 A
3,859,805 A * 1/1975 Johnson et al. ..... 114/74 A
3,894,505 A * 7/1975 Murphy ..... 114/74 A
4,126,099 A * 11/1978 Lange ..... 114/74 A

* cited by examiner

*Primary Examiner* — Lars A Olson
(74) *Attorney, Agent, or Firm* — Manelli Selter PLLC; Edward J. Stemberger

(57) ABSTRACT

The present invention comprises a tank for liquefied gases or a so-called cryogenic tank (1) with a tank bottom structure (10) and a tank wall structure (11) arranged around a circumference of the tank bottom structure (10). The tank bottom structure (10) is provided with a tank bottom hub (2) adapted for being held by a bottom hub retainer (20) on a tank support structural floor (23). The tank is simple to install, cheap in production and handles in an improved manner forces acting upon it.

22 Claims, 12 Drawing Sheets

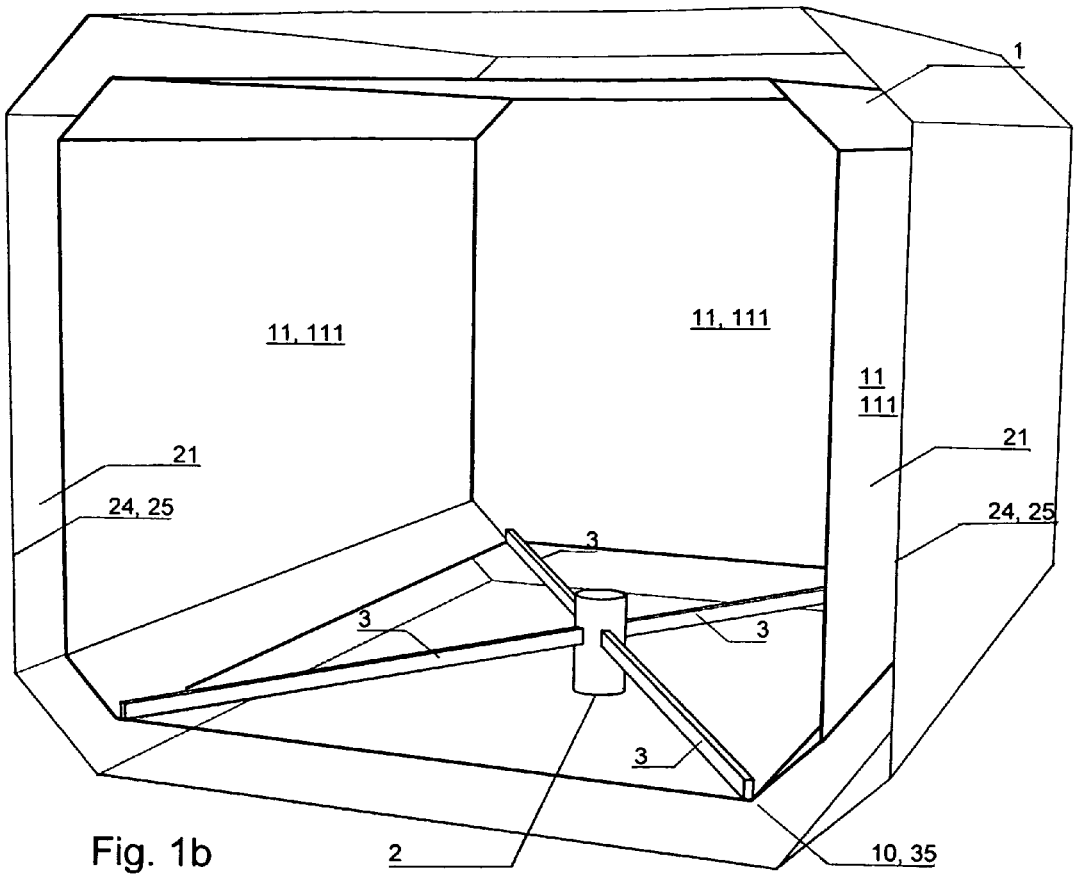
Fig. 1b
Fig. 1c
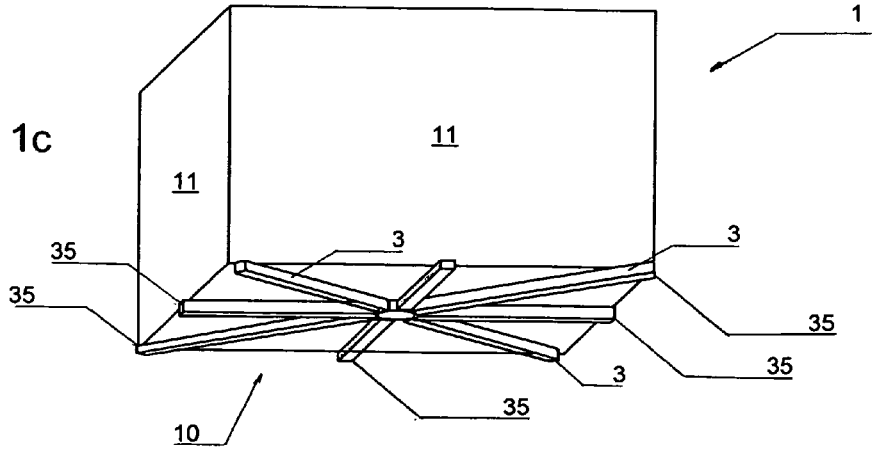

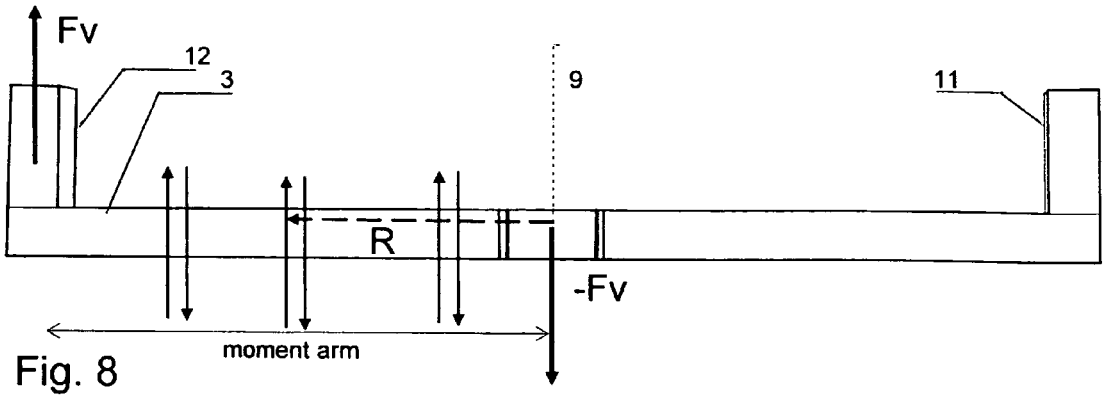
Fig. 8
Fig. 9a
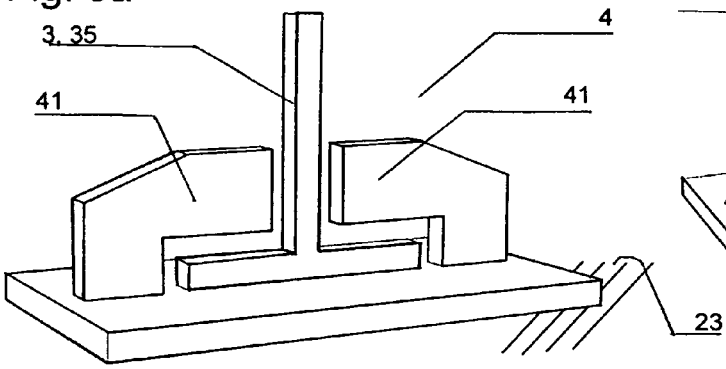
Fig. 10
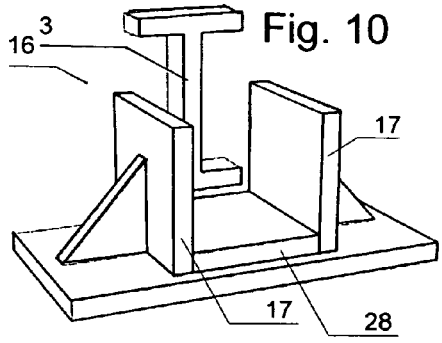
Fig. 9b
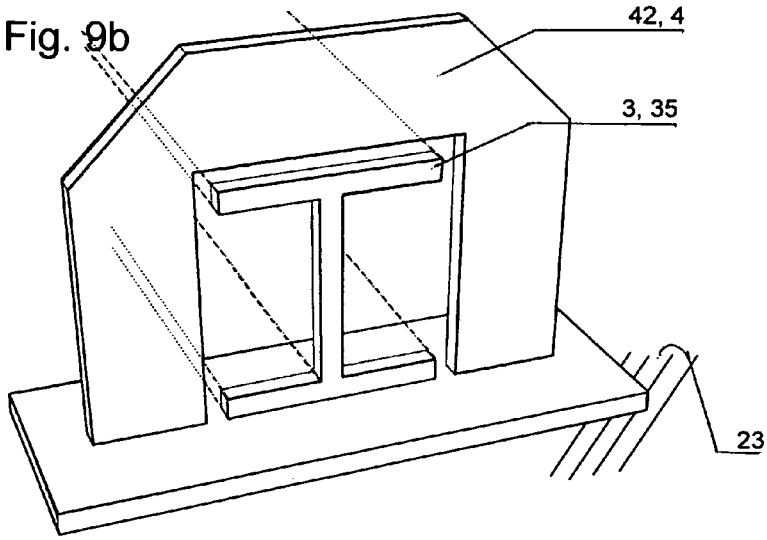

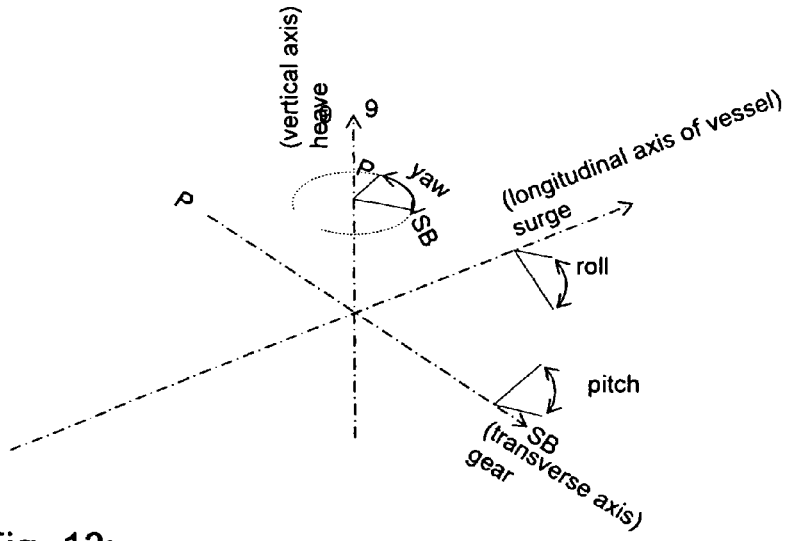
Fig. 13: translational and rotational motions of a vessel: roll about long. axis, pitch about the transv. axis, and yaw about the vert. axis.
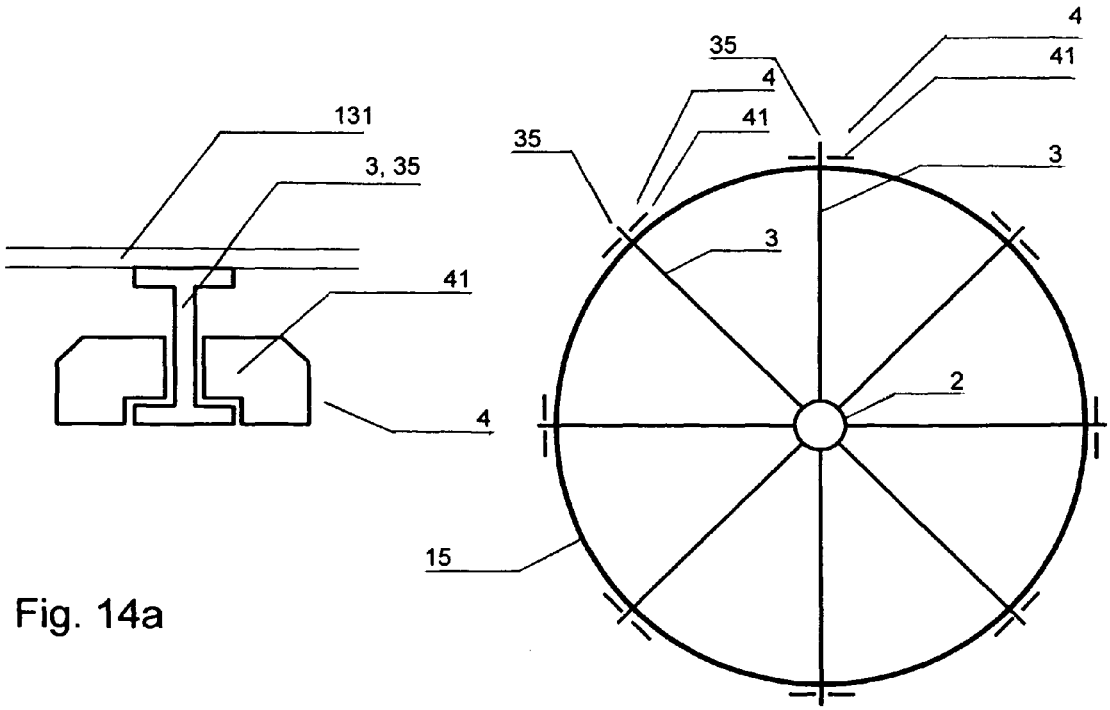
Fig. 14a Fig. 14b
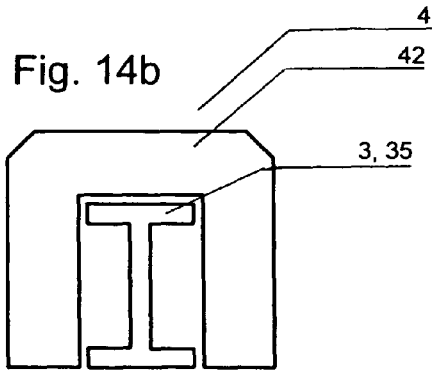
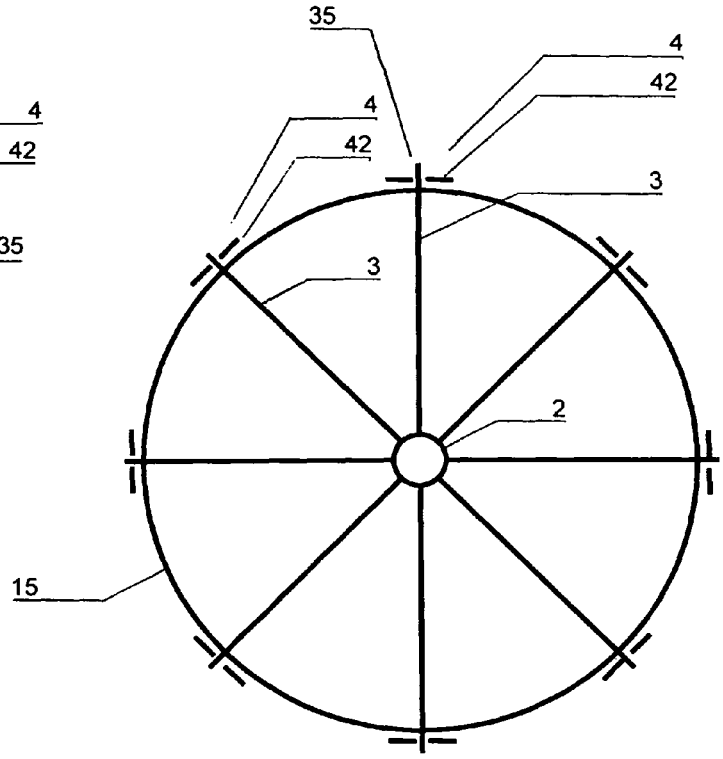
Fig. 15a
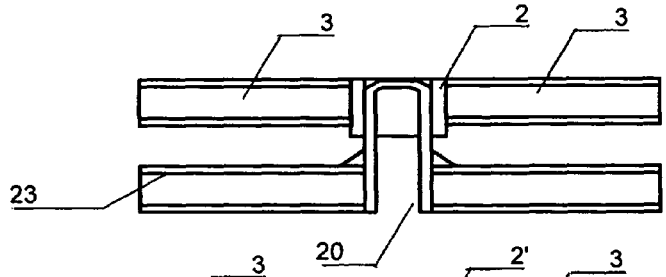
Fig. 15b
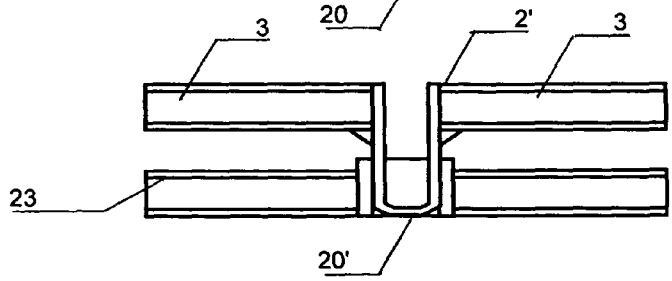

LIQUEFIED GAS TANK WITH A CENTRAL HUB IN THE BOTTOM STRUCTURE

This application claims the benefit, for priority purposes, of the earlier filing date of U.S. Provisional Application No. 60/996,722, filed on Dec. 3, 2007.

BACKGROUND

The worldwide need for energy requires that large amounts of fuel be transported from the areas in which they are found to the consumer. One of the cleanest and most abundant energy forms for practical use today is natural gas. The major gas fields are usually situated far from the main consuming markets and there is thus the need for transporting the gas to the consumer from the fields. Pipe line transportation is one of the possibilities which may be considered, however piping is quite expensive and unfeasible for long range transportation. Ship transportation thus remains the practical solution for gas transportation applications, in particular transportation of liquefied gas.

The present invention relates generally to liquefied gas tanks such as LNG tanks or LPG tanks, although the term cryogenic tank is used generally in this description. LNG is usually kept in the tank at the boiling point of about −163° C. at atmospheric pressure, constantly boiling off methane. In order to reduce the boil-off, the thermal influx through the tank wall may be sought reduced by arranging an insulation layer about the tank walls. The tank walls must be structurally supported and stabilized, but all such structurally supporting parts may conduct heat into the tank and thus induce undesired boil-off. It is thus desirable to reduce the total cross-section of structurally supporting parts extending through the insulation layer in order to reduce the thermal influx. A general problem with LNG tanks and other cryogenic tanks is the thermal contraction that takes place during the initial cooling and filling of the tank, and possibly the thermal expansion of the tank if the LNG is removed from the tank due to evaporation or by being emptied.

LNG tanks are often retrofitted onto previously built ships or tankers, but may also be directly installed on installations such as floating production and storage units (FPSO) and floating storage and regasification units (FSRU). For these applications simplicity of installation is critical to reduce cost, as is availability of deck space. There are furthermore a number of cryogenic tank applications onshore in industrial use. The various applications present different issues to be resolved, some of the main problems being the temperature, volatility and toxicity of the gases. A number of tank designs have been proposed for these applications all having advantages and disadvantages.

When performing a cryogenic filling process the bottom plate structure and the tank wall structure of a tank will contract when the tank cools from ambient temperature. The bottom plate structure and the lower part of the circumference of the tank wall structure will contract first, then, through thermal conductivity and through direct liquid and evaporated gas contact with the wall, the tank wall will cool and contract while the tank is filled with the liquid natural gas. Particularly for LNG ship tanks but also for some land tanks it is required that the tank is prevented from moving laterally relative to the substrate during cooling. For ship tanks this lateral stabilization is important during sailing. Cryogenic inner tanks need to be designed to tolerate the thermal contraction of the tank with respect to the supports. This occurs due to the low temperature of the cryogenic fluid which naturally will lower the temperature of the tank itself and the supports to which it is fixed. In addition to the contraction of the tank which occurs while filling the tank with the cryogenic fluid, there will be a corresponding expansion of the tank upon emptying the tank.

The differential thermal contraction may induce strains in the tank wall liner plate, the tank wall girder structure, and in the supporting compartment structure. Strains in the LNG tank liner plate may incur cracks that may result in leaking of LNG which is critical due to the risk of fire and explosion, and due to the toxicity of the methane. Tank breakage and resulting leakage of cryogenic gas in a vessel may furthermore result in the catastrophic loss of a vessel as the structural steel of such vessels is not designed for being exposed to such low temperatures.

For ships and other vessels one has a major issue in connection with sloshing of the LNG due to the action of waves upon the vessel or due to the vessel movement itself. Sloshing may induce failures in the tank, and the tank should thus be designed to withstand sloshing effects. The present invention describes a practical solution to some of the above-mentioned challenges.

BACKGROUND ART

U.S. Pat. No. 2,905,352 shows an early attempt to form a stabilised tank system arranged for being placed in a ships hull, wherein the tank system is stationary within the ship whilst also allowing for the contraction and expansion of the tank responsive to temperature change. Below the tank there is arranged a guide in the ship floor comprising longitudinally arranged slots extending lengthwise in the ship whereupon the tank having corresponding keys fixed to its bottom plate is arranged to be placed onto the ship floor, the keys of the tank fitting into the slots.

U.S. Pat. No. 3,612,333 provides a further development upon the principle shown in the above-mentioned U.S. Pat. No. 2,905,352, wherein the keys, keyways and bearer supports are located at the bottom of container, and wherein the keys are located on lines mainly corresponding to the longitudinal and transverse centrelines of the tank.

U.S. Pat. No. 4,013,030 to Stafford, "Support for LNG ship tanks" describes a tank support system located about a circular horizontal section of a tank. The support system comprises a number of identical supporting units spaced around the circular horizontal section of the tank. Each of the supporting units are joined to the tank, and also to a base. Each supporting unit has a bottom hub for resting on a corresponding cylindrical sleeve. The sleeves are arranged on a substructure on the ship and are allowed to move radially but not laterally relative to the tank. This allows contraction and expansion of the tank while preventing the tank as a whole from moving laterally.

U.S. Pat. No. 5,531,178 to Abe et al. "Support structure for self-standing storage tank in liquefied gas carrier ship" describes a prismatic tank for liquefied gas of which said tank is arranged in a tank compartment with bottom supports under the tank that allow the tank to expand and contract in the lateral directions. The support structure is provided with longitudinal movement restrainers along a transversal line which prevents the entire tank from moving in the ship's fore-aft direction, and lateral movement restrainers arranged along the centreline of the ship for preventing the tank from moving in the starboard-port direction. There are a number of support points arranged for carrying the tank, a design which greatly complicates the installation of the tank. The supports will increase the design weight, and the supports would furthermore seem to be arranged in a non-symmetrical manner. This lack of symmetry will result in an uneven stress distribution during cooling. The design will also transfer moment loads into the ship structure.

U.S. Pat. No. 6,971,537 describes support arrangements for semi-membrane tank walls wherein the support assemblies provide vertical support for the tank walls while permitting relative motion in the horizontal direction. This design will cause there to be substantial point loads in all tank walls which is undesirable. The design is complicated and expensive, thus increasing installation time and cost, and increasing the difficulties in converting older vessels into LNG tankers.

DE-patent 1506761 describes a method for transporting LNG wherein a plurality of tanks are arranged as a single unit within a ships hull, and wherein said unit is supported by a plurality of column bases, some of which are arranged about the circumference of the tank, and wherein there is at least one central column base. The design necessitates bulkheads athwart ships capable of handling the roll loads at the top of the tanks. This will increase weight, cost and complicate the construction of the tank, DE-patent 1781041 "Tankschiff zum Transport von Flüssiggasen" describes in a similar manner a support structure for a prismatic tank of which a longitudinal movement restrainer is arranged below the center of the tank, and lateral movement restrainers are arranged under the fore and aft center portions of the tank. Spaces between the support structure portion of the restrainers and the tank bottom structure of the restrainers are adapted for receiving locking pads which are locked in place while the tank contracts during the cooling process when being filled with liquefied gas. Along the starboard and port sides of the tank compartment are lateral movement restrainers also provided with such locking pads for engaging the tank with the support structure when cooled down. This is an exceedingly complicated design, and requires very precise machining in order to achieve the required tolerances. Thus the tank will be very costly. Furthermore, this design will transfer loads into the ship structure from the tank, loads which are uncontrollable, and to some extent unpredictable. If heated to above the intended cold operation temperature of the tank, the locking pads will run out of engagement and the tank may roll in an uncontrolled manner in the tank compartment.

SUMMARY

The present invention seeks to resolve at least some of the above technical problems and comprises a tank for liquefied gas, with a tank bottom structure supporting a tank wall structure arranged around a circumference of said tank bottom structure, wherein said bottom structure is provided with a central tank bottom hub adapted for being held by a bottom hub retainer on a tank support structural floor, wherein said central tank bottom hub is arranged for providing radial support forces in directions parallel to said tank bottom structure.

Further embodiments of the invention are given in the dependent claims.

ADVANTAGES OF THE EMBODIMENTS

A first advantage of the embodiments is that all support of the liquefied gas tank in the lateral direction is guided through the central hub, thus no lateral support of the cryogenic tank is required, thus no "cold bridges" through the insulation layer surrounding the tank wall are made, thus the insulation is more continuous and more easily installed. Further, the insulation is more easily removed if required, such as for inspection of the tank or the tank compartment, or for repair or modification of the tank.

A second advantage of the embodiments is that because the tank is fixed to one single origin through the central hub, all contraction of the tank relative to the tank compartment during cooling of the cryogenic tank will take place in a generally radial direction relative to this single hub. The allowance for radial expansion or contraction made by the vertical retainers arranged for the tank bottom structure thus facilitates the mechanical adaptation of the cryogenic tank to the tank compartment, and facilitates heating the cryogenic tank to ambient temperature. No special considerations are required for adapting lateral supports along the cryogenic tank walls as hamper the prior art cryogenic tanks.

A third advantage of the embodiments due to the vertical retainers arranged along the periphery of the tank bottom structure is that vertical forces from the tank wall due to sloshing of the cargo, rolling of the ship, pitching, and even grounding or collision, is that such forces are directed from the lower part of the wall structure, generally straight down through the rim of the bottom plate structure, and down into the vertical retainers fixed to the tank support substructure of the ship. Thus undesired shear forces in the tank bottom structure (and in the wall structure) as will arise from the tanks of the prior art, are largely eliminated.

A fourth advantage of the embodiments, with the structure having vertical retainers arranged periperally at the outer ends of the beams of the tank bottom structure is the fact that the tank bottom structure may have the beam structure arranged on top of the bottom liner plate, and provide a lowered centre of gravity of the cryogenic tank in the ship, and further provide an enlarged tank volume as compared to tanks having an external beam structure.

Still another advantage of a prismatic tank according to the embodiment is the fact that the tank volume may be significantly increased as compared to a vertical cylindrical tank

BRIEF DESCRIPTION OF DRAWINGS

The invention is illustrated in the accompanying drawings, wherein:

FIG. 1*b* is perspective illustration of a prismatic embodiment of a cryogenic tank according to the invention, the tank seen from slightly over and to the side of the tank's and the ship's longitudinal axis.

FIG. 1*c* is a simplified view of a prismatic embodiment of a cryogenic tank according to the invention, the tank seen in an isometric view slightly from below, showing the main elements of a bottom plate structure of such a prismatic tank.

FIG. 8 illustrates shear forces which may arise in a horizontal beam in a tank bottom structure of the prior art if subjected to an uncompensated lifting force acting on a wall standing on the end of a beam while the bottom structure is fixed elsewhere along the bottom structure. Such uncompensated shear forces in the tank bottom structure are largely eliminated through the invention.

FIG. 9*a* is a close-up illustration of an arm-type vertical retainer for a beam, this figure corresponding to the arm-type vertical retainers of FIG. 5*a*, the beam only partly shown in section of the lower flange only.

FIG. 9*b* is a close-up illustration of an arm-type vertical retainer for a beam, this figure corresponding to the inverted "U"-shape bridle clamp vertical retainers of FIG. 5*b*, the outer portion of the beam shown, and part of the remaining portions drawn in broken lines.

FIG. 10 is an illustration an anti-rotational support for a radial beam.

FIG. 13 illustrates the different translational and rotational movements of a marine vessel.

FIG. 14*a* illustrates in a bottom view and an enlarged lateral view of an embodiment of the invention showing arm-type peripheral vertical supports.

FIG. 14*b* illustrates in a bottom view and an enlarged lateral view of an embodiment of the invention showing inverted "U"-type bridle clamp peripheral vertical supports.

FIG. 15*a* illustrates a simplified vertical section through a tank bottom structure according to a preferred embodiment of the invention with a central hub of a female type welded in between inner ends of radial beams, the central hub entered onto a male type central hub retainer fixed in the framework of a supporting beam substructure for holding the tank.

FIG. 15*b* illustrates a simplified vertical section through a tank bottom structure of an alternative embodiment of the invention, with a central hub of a male type welded in between inner ends of radial beams, the central hub entered into a central hub retainer of the female type which fixed in the framework of a supporting beam substructure for holding the tank.

DETAILED DESCRIPTION OF EXAMPLE EMBODIMENTS

Figure 7A:
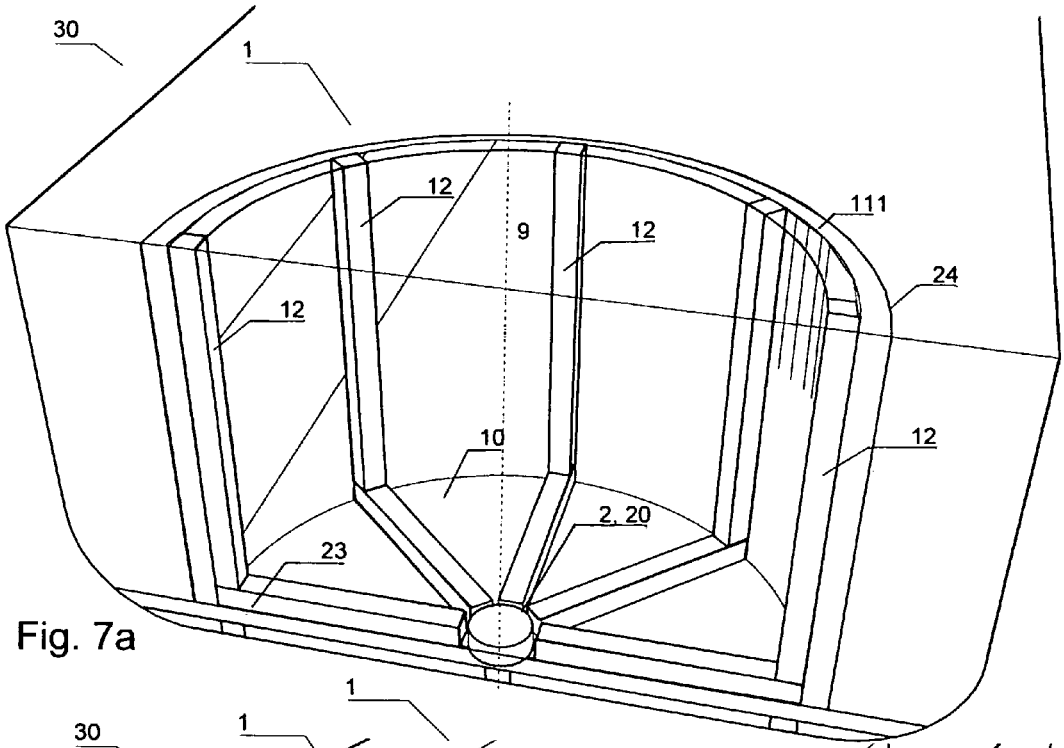
FIG. 7*a* is a perspective view and cross-section of a ship's hull with a vertical cylinder-shaped tank compartment centered on the central longitudinal bulkhead and with a section of an insulated cryogenic cylindrical tank according to the invention.
Figure 7B:
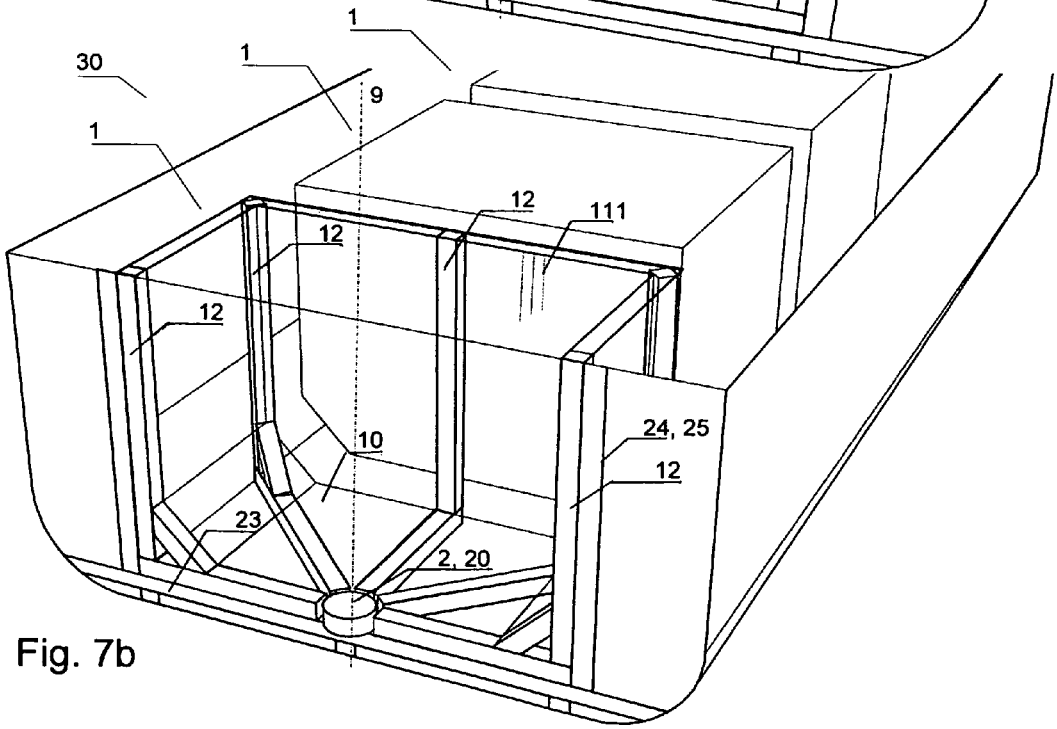
FIG. 7*b* is a perspective view and cross-section of a ship's hull with a series of prismatic tank compartments along the central line of the ship and with a section of such an insulated cryogenic prismatic tank according to the invention.

The invention comprises a tank (1) for liquefied gases such as liquefied methane (LNG), liquefied ethane, liquefied propane (LPG), or other liquefied gases. The tank (1) according to the invention is for use on a ship or other marine vessel, The term ship or marine vessel used in this specification further comprises floating and semisubmersible petroleum production or storage vessels. Further, the tank according to the invention may be arranged on fixed marine structures. The tank described is designed for use under atmospheric pressure, but pressurized tanks are also considered. The tank according to the invention is hereafter generally called a cryogenic tank (1), but the invention is not limited to tanks for the cryogenic temperature range but to liquefied gases such as the gases mentioned above. The tank (1) for liquefied gas is provided with a tank bottom structure (10) and a tank wall structure (11) arranged around a circumference (15) of said tank bottom structure (10). Wall column beams (12) are arranged for constituting part of the tank wall structure (11). The tank wall structure (11) will usually support a tank top. The tank bottom structure (10) is provided with a generally centrally arranged tank bottom hub (2), said bottom hub (2) adapted for being held by a bottom hub retainer (20) on a tank support structural floor (23), please see FIGS. 1, 2, and 7. The tank hub (20) may provide support forces generally directions parallel to the plane of said tank bottom structure (10).

The tank (1) according to the invention allows the tank to be retained through a single point hub (2) of the tank bottom structure (10), said hub (2) being retained by the hub retainer (20) on a tank bottom supporting structure (23).

Thermal contraction movements of a large ship tank from ambient temperature to cryogenic temperature may be of considerable size. An essential advantage of the tank being prevented from lateral movement through being laterally anchored through one central hub is the fact that little or no thermal strain may build up during cooling while initially filling the tank with liquefied gas, as the tank is restrained in one point only, the remaining structures such as beams (3) of the tank bottom structure (10) extending or contracting in directions running through this central hub (2).

The ship is affected in six translational and rotational degrees of freedom: roll, pitch, and yaw for the rotational movements, and heave, surge and gear for the translational movements, please see FIG. 13.

According to the invention, the hub (2) will thus provide support against forces acting in the lateral plane on the tank, wherein said hub (2) alone provides the necessary lateral plane force to the tank hub retainer (20) on the tank supporting structure (23). This is an improvement upon earlier designs having a plurality of keys, slots and the like, wherein each key or slot was arranged for providing support merely in a single direction. The hub (2) should be arranged generally close to the center of the tank bottom structure (10) so as for avoiding imbalances in the hub. Another advantage of this design lies in that the thermal expansion/retraction translations occur on only along maximally half the dimension of the tank bottom structure, not along the entire length or diameter of the tank bottom structure. The tank bottom structure (10) may be constructed in one compact material piece such as concrete, or the tank bottom structure (10) may preferably be constructed using radial beams (3) as described below.

In a preferred embodiment of the invention beams (3) extend horizontally and radially from the central hub (2) and support or hold fluid-proof bottom liner plates (113) of the tank (1). Vertical girders (12) rise from near the outer ends of the radial beams (3) and support the liner plates (111) of the tank wall structure (11) of the tank (1). The radial beams (3) provide support for the tank floor as well as distributing forces acting on the tank throughout the tank vessel. This is of importance if the tank is in a partially filled condition as there might be significant sloshing due to forces acting upon the tank (1) such as rolling and pitch. This is a problem in particular when the tank (1) is mounted on a floating vessel such as an FPSO or FSRU or a LNG tanker. Sloshing might arise in land-based cryogenic tanks as well due to seismic events, and for land tanks it is vital to provide a tank being capable of withstanding seismically induced forces (which may be due to seismic accelerations near 1 g horizontally), and the resulting sloshing.

Forces in the lateral direction due to relative accelerations between a marine vessel's (30) tank support floor (23) and the LNG fluid load due to roll, pitch, surge and gear must be transferred particularly through the tank wall structure (11), and responsive forces from the LNG cargo due to sloshing and roll and pitch accelerations will arise. As mentioned above this is a particular problem for marine vessels. Within wide ranges of roll, pitch, surge and gear, the bottom hub (2) held by the hub retainer (20) on the tank support structure (23) will keep the tank (1) in place. The tank bottom structure (10) will otherwise be supported in the vertical direction by the general substructure below the tank, namely the tank support bottom (23). The support bottom (23) may be constituted by a longitudinal central frame bulkhead and laterally arranged longitudinal frames of the ship together with transverse bulkhead frames. The compartment bottom (23) is provided with said tank hub retainer (20). The compartment bottom (23) shall also comprise a bottom liner plate on the framework, the bottom liner plate for supporting a bottom insulation layer below the LNG tank, the insulation layer penetrated by the hub retainer (20) and the central hub (2) and possible retainers of other types specified below, and possible piping.

Figure 1A:
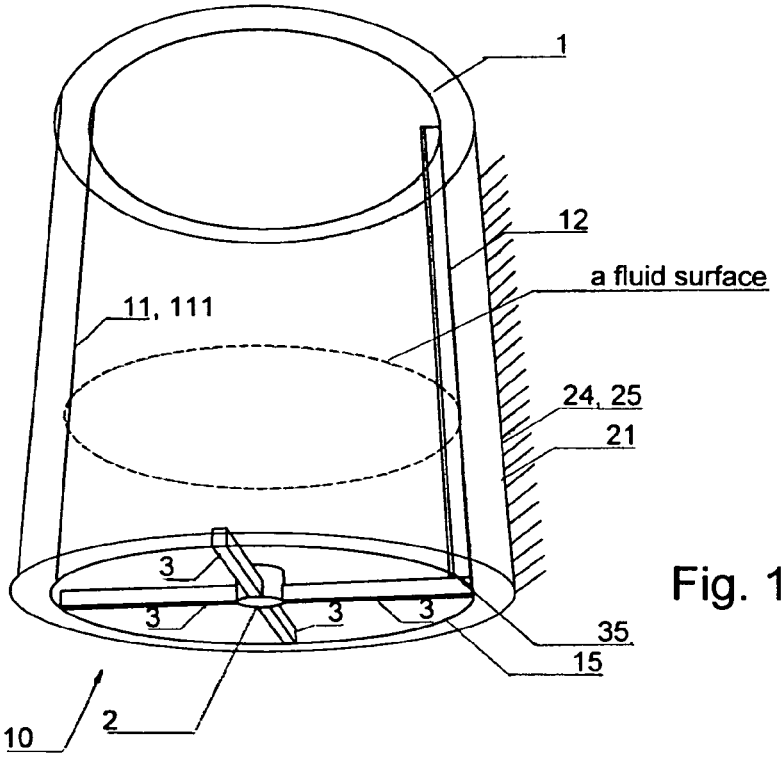
FIG. 1*a* is a rough sketch of a cylindrical embodiment of a tank for liquefied gas, hereafter called a cryogenic tank, according to the invention, the tank seen slightly from the side of the tank and below the tank bottom structure.
Figure 2A:
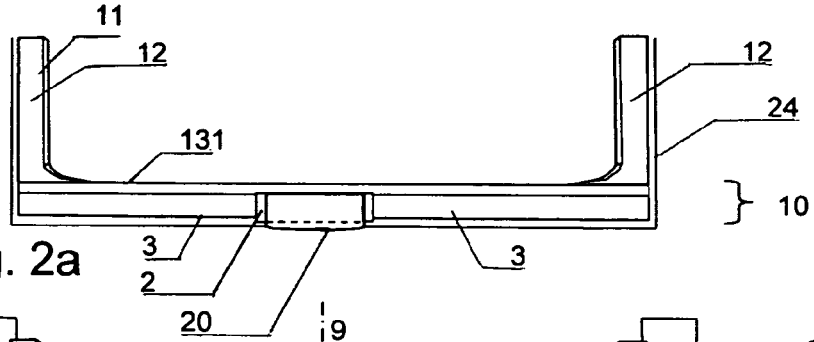
FIG. 2*a* is a simplified vertical section through a bottom structure of a tank according to the invention, with the tank resting on a tank support structural floor in a tank compartment. In this embodiment, the bottom tank structure is a so-called external mechanical structure with the bottom liner plate arranged on top of the bottom structure's beams.
Figure 3A:
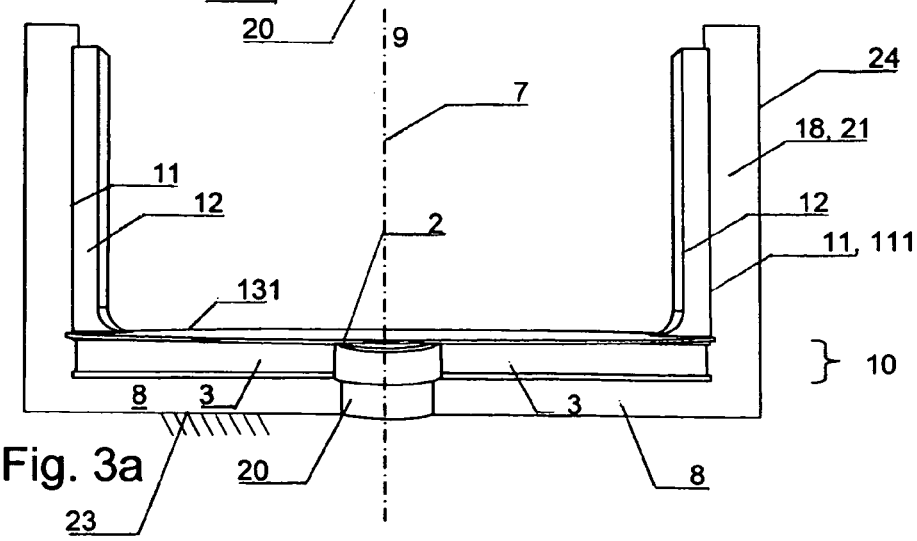
FIG. 3*a* is, as FIG. 2*a*, a simplified vertical section through the tank of the invention in which the cylindrical wall liner plate is supported by vertical girders arranged on the ends of the radial beams of the tank bottom structure, the cylindrical wall and the bottom wall structures being insulated from the tank compartment bottom and walls.
Figure 2B:
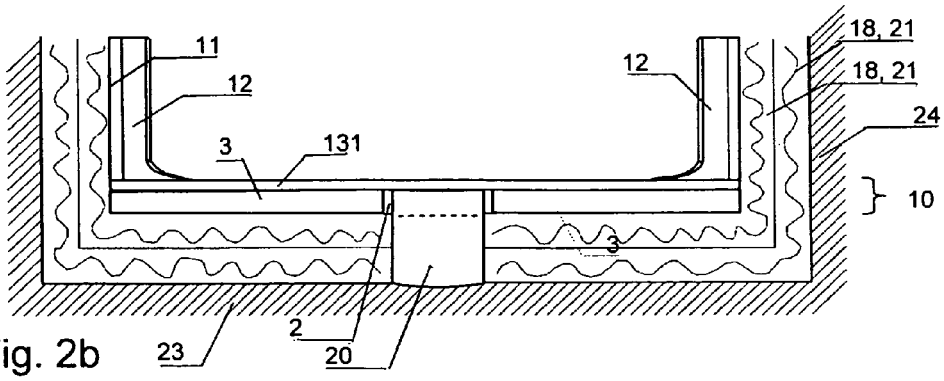
FIG. 2*b* is a front view of a simplified vertical section through the tank of the invention in which the cylindrical wall liner plate is supported by vertical girders arranged on the ends of the radial beams of the tank bottom structure, the cylindrical wall and the bottom wall structures being insulated from the tank compartment bottom and walls.
Figure 3B:
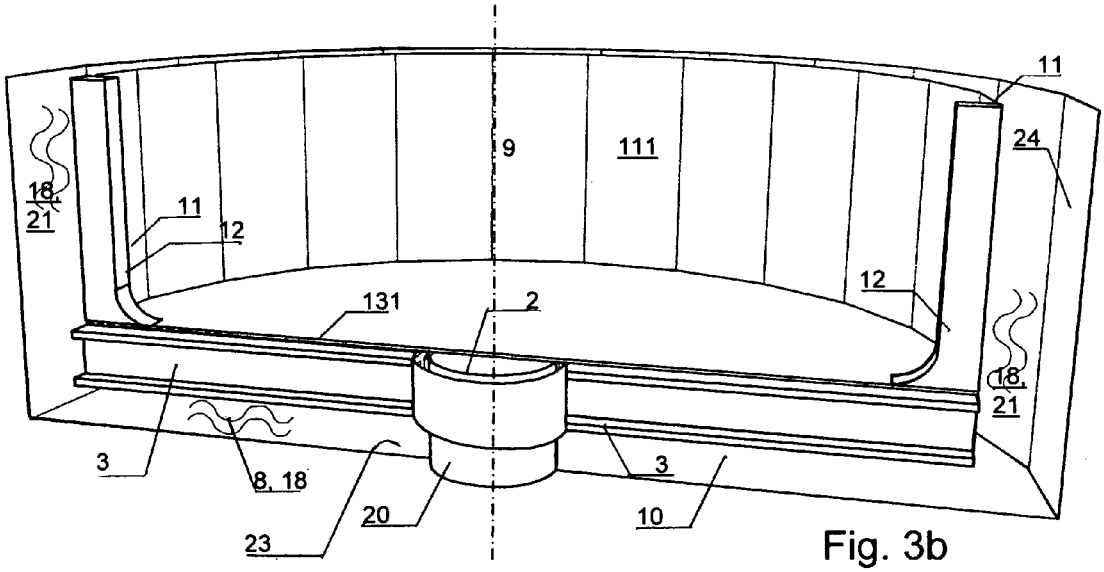
FIG. 3*b* is a perspective view corresponding to FIG. 2 and illustrates an internal beam wall structure erected on a so-called external structure tank bottom structure.

As shown in FIGS. 1*a* and 1*b*, the cryogenic tank (1) may be arranged in a tank slot compartment with a wall (24). Although a cylindrical tank is shown illustrated i FIG. 1*a*, other geometries should be considered as being within the scope of the invention, such as any kind of prismatic geometry in particular being of rectangular shape as illustrated in FIGS. 1*b* and 1*c*, and in FIG. 11*c*. The choice of geometry is a design issue which although central to the design of the ship itself is not central to the present invention. One may for instance envisage a spherical tank wherein a bottom portion of the tank wall structure has been removed, and replaced by a mainly planar tank bottom structure thus being furnished. Upon this tank bottom structure (10) may be arranged a central hub (2) and possibly the radially arranged beams (3) according to an embodiment of the invention. Details of the arrangement of a cryogenic tank (1) arranged within a marine vessel are shown in FIG. 2*a* and in FIGS. 7*a* and *b*, and in FIGS. 11*a, b*, and *c*. FIG. 2*a* further illustrates some of the details shown in FIG. 1, such as the ship's tank hub retainer (20) on a the ship tank bottom (23) of a tank slot in the ship. FIG. 3 illustrates further details such as bottom insulation (8), cylinder wall insulation (18) and a vertical tank axis (9). The ship tank slot bottom (23) serves a variety of purposes, however one of the major advantages of using this system is that the tank may be prefabricated on shore, and simply being hoisted and lowered into the upon ship's tank slot onto the hub retainer (20) in one simple operation. This may significantly ease the installation of cryogenic tanks in ships. This is a significant advantage as many FPSU and FSRU vessels are modified surface vessels. Thus the modification of the ship and the construction of the cryogenic tanks may take place concurrently instead of sequentially. In the same manner, if there should be need for removal of the tanks for maintenance, a cryogenic tank may simply be hoisted out of the vessel. This contrasts greatly to the costly and difficult maintenance of LNG tanks as known in the background art.

A significant advantage of the internal beam structure in the tank bottom structure as illustrated in FIG. 1*b* is the fact that the bottom liner plate resides lower, thus the tank volume is increased while the centre of gravity of the tank may be lowered, providing both economic and stability advantages.

Lateral forces between the ship and the liquefied gas are, by virtue of the invention, transferred radially through the central hub (2), through the entire bottom structure (10), as compressional and/or tensional forces through the bottom plate structure, and further transferred as shear forces from the tank bottom structure (10) into the tank wall structure (11) which is erected about a circumference of the bottom plate structure (10). It is assumed that the force transfer for a tank structure according to the invention better distributes throughout the tank structure and thus prevents crack formation, particularly in the lower peripheral transition between the tank bottom liner plate (113) and the tank wall liner plate (111). Thus strains due particularly to rolling, pitching and resulting sloshing may be reduced in a tank according to the invention as compared to the prior art.

According to an embodiment of the invention the tank bottom structure (10) comprises at least three, preferrably four or more radial beams (3) attached with their radially inner ends to said central hub (2). The radial beams (3) shall in a preferred embodiment of the invention support vertical girders (12) extending from near the outer ends of said radial beams (3). Non-permeable liner plates (131, 111) preferably form the impermeable tank liner of the tank bottom and tank wall structures (10, 11). The liner plates are attached to the beam and girder (3, 12) structures. The tank wall structure (11, 12) may be reinforced in the circumferential direction by rods, bands or wires, or may be provided with hoop windings of wire or glass fiber, aramid fiber, carbon fiber or the like, and the tank may be provided with a top with a circumference corresponding to the bottom circumference. The top of the tank according to the invention would not require any lateral retainer because all translational and rotational action-reaction force transfers occurs through the bottom plate structure.

The central hub (2) is essentially not arranged for retaining the tank (1) from moving in the vertical axial direction. Although such a vertical retaining function via the central hub (2) is imaginable, such as illustrated in FIG. 8, such a retaining function would be indirect with respect to the tank wall structure (11), and would involve transfer of vertical forces from the tank wall structure (11) through undesired vertical shear forces in the beams (3) of the bottom plate structure (11).

Figure 5A:
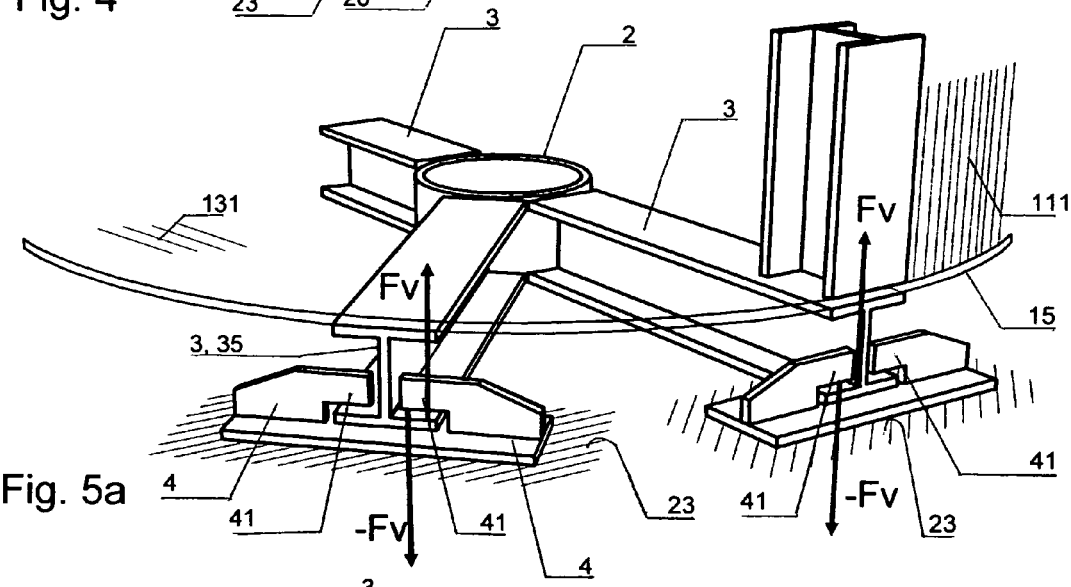
FIG. 5*a* is a perspective view of example vertical retainers with arms arranged for holding about the lower flange of the radial beams of the bottom structure.
Figure 11A:
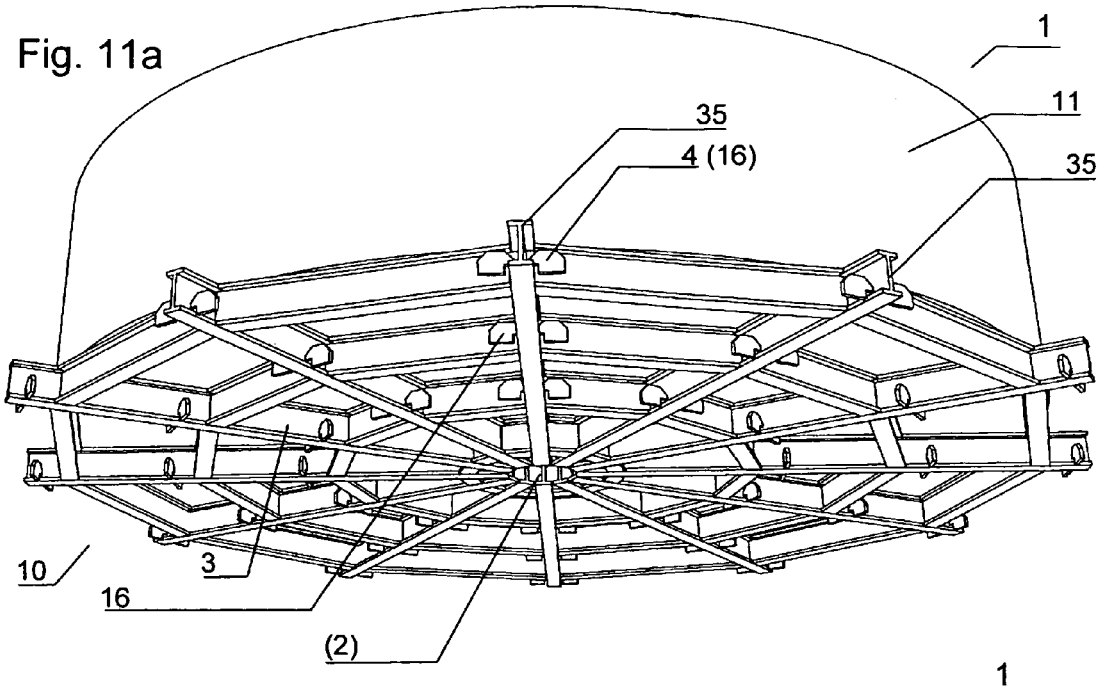
FIG. 11*a* is a simplified design view of the bottom structure of a cylindrical tank according to an embodiment of the invention showing the central hub of the tank bottom structure, radial H-beams supporting the bottom liner plate of the tank and a cylindrical wall structure extending above near the outer ends of the radial beams of the bottom structure, with near-circumferentially extending H-beams spanning between the radial beams. Arm-type vertical retainers are arranged near the outer ends and holding the horizontal beams, and several series of such arm-type vertical retainers of shorter radial positions are arranged nearer to the central hub.
Figure 11B:
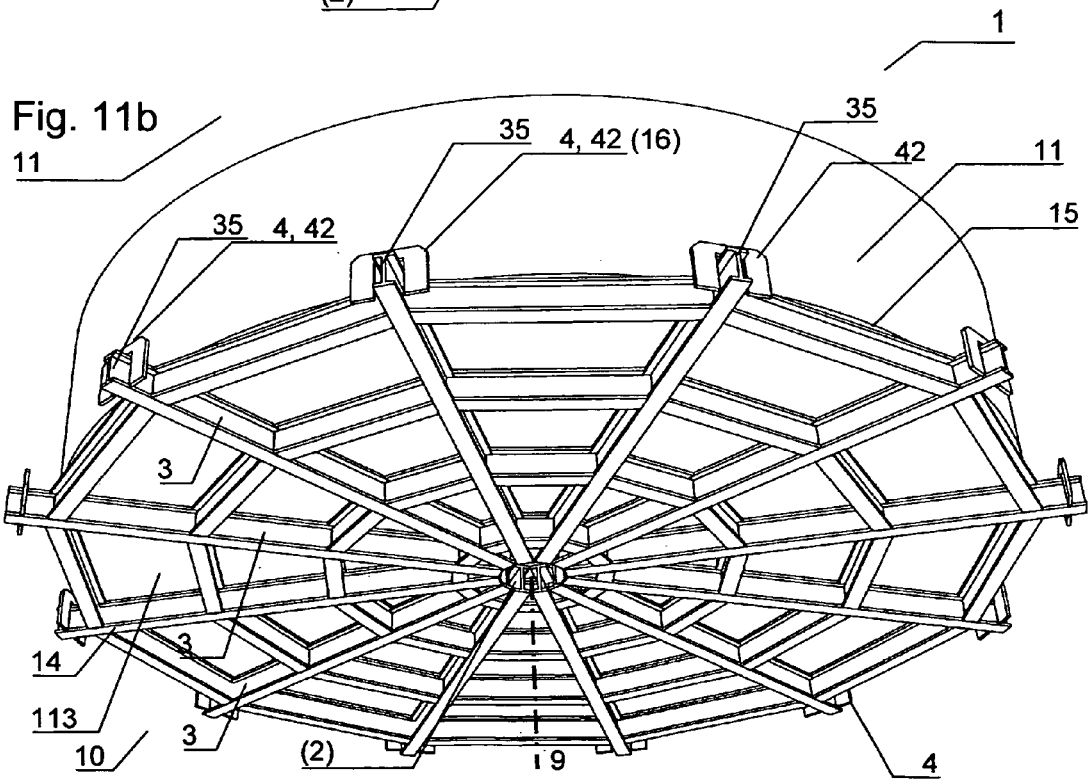
FIG. 11*b* is an almost similar design view of the bottom structure of a cylindrical tank according to an embodiment of the invention, using only inverted "U"-shape bridle clamp vertical retainers for holding the outer ends of the beams of the tank bottom structure. This design is simpler and clear cut embodiment of the invention corresponding to what is illustrated in FIG. 4 and to FIG. 5*b*. The vertical retainers of FIG. 11*a* and FIG. 11*b* may also play as anti-rotational retainers against rotational moments about a vertical axis through the central hub or the tank.
Figure 11C:
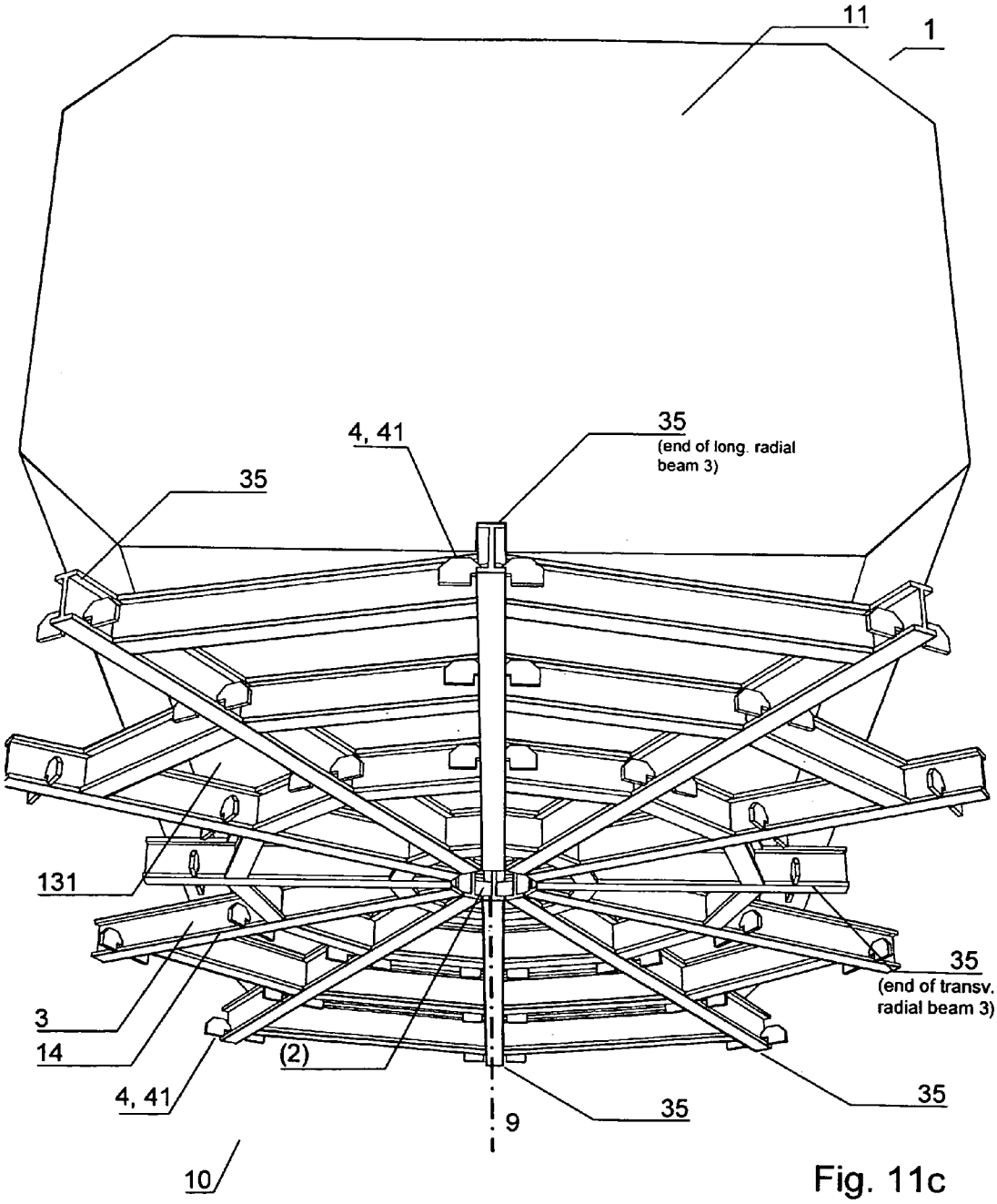
FIG. 11*c* is a perspective view along a central radial beam and seen slightly from below the bottom structure of a cryogenic tank according to the invention. The tank is prismatic but the tank bottom beam structure and the vertical retainers correspond largely to the tank bottom structure illustrated in FIG. 11*a*.

The central tank hub (2) and its corresponding tank hub retainer (20) preferably handle only forces in a horizontal plane in the ship's neutral position. According to an embodiment of the invention, transfer of upwardly directed forces on the tank wall structure (11, 12) relative to the ship's tank recess bottom (23) is conducted through vertical force retainers (4) arranged between the tank support recess bottom support structure (23) and the circumference (15) of the tank bottom structure, preferably the outer portions (35) of the beams (3) of the tank bottom structure (10). In an embodiment of the invention the vertical force retainers (4) comprise a base plate welded or otherwise attached to the substructure (23), with standing support plates welded onto the base plate, said standing support plates provided with arms (41) for embracing the lower lateral flanges of the flat lying H-beam cross-section of said radial beams (3). This is illustrated in FIGS. 5*a*, 9*a*, 11*a* and *c*, 12*a* and 14*a*. The plates with the arms (41) may be welded in place after the tank has been lowered into its correct position on the hub retainer (20) in the compartment. Although H-beams have been shown, any suitable beam structure may be used as is evident.

In another embodiment of the invention the vertical force retainers (4) comprise a base plate welded or otherwise attached to the substructure (23), with standing support plates welded onto the base plate, said standing support plates comprising inverted "U"-shape bridles or arcs (42) for embracing the outer portions (35) of the horizontal radial beams (3). This is illustrated in FIGS. 5*b*, 9*b*, 11*b*, 12*b* and 14*b*. The inverted "U"-shaped vertical retainer plates (42) may also be welded in place after the tank has been lowered into its correct position on the hub retainer (20) in the compartment.

Figure 5B:
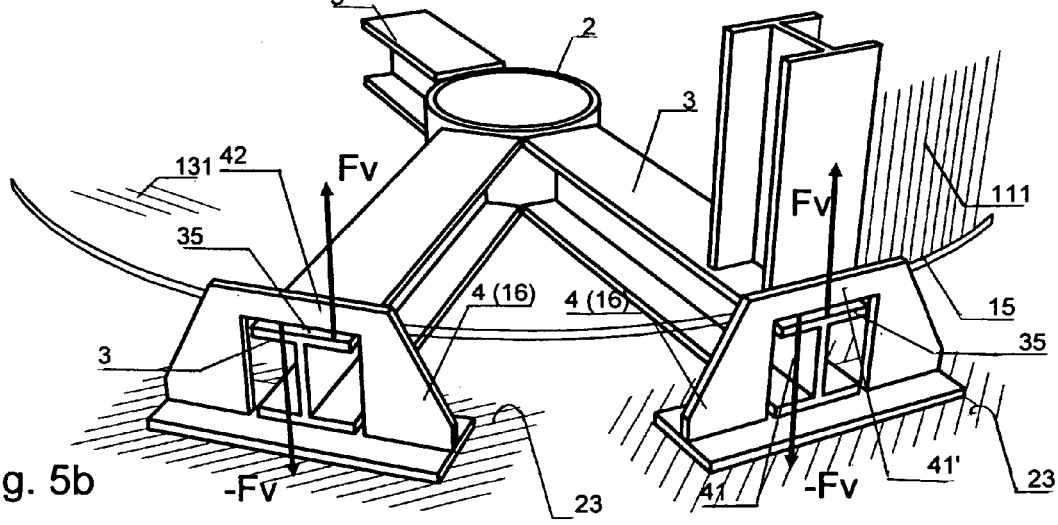
FIG. 5*b* is a corresponding perspective view of example vertical retainers forming inverted "U"-shaped bridle clamp vertical supports attached to the tank supporting substructure and arranged over the outer end portions of the horizontal beams of the tank bottom structure, the end portions extending beyond the periphery of the tank wall.

FIGS. 5*a* and 5*b* illustrate that vertically directed lifting forces arising in the tank wall structure (11, 12) will be counteracted by the vertical force retainers (4) arranged directly below the tank wall structure (11) and guided into the supporting substructure (23) of the ship. Thus sloshing forces and roll forces and roll accelerations, which may be severe in high sea states or due to listing incurred from displaced load or due to an accident, such forces may be counteracted at least up to a pre-defined static angle and for a full tank, for e.g. a heel of up to 30 degrees to the port or starboard side.

Figure 4:
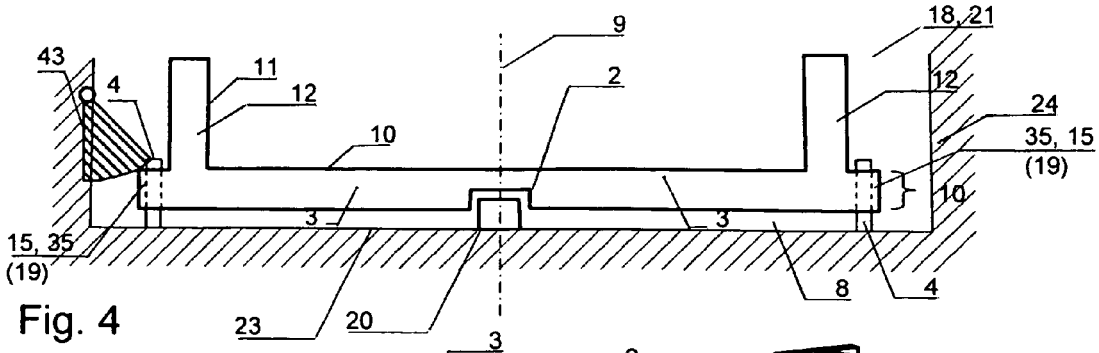
FIG. 4 illustrates, in a vertical cross-section of the lower portion of a simplified tank according to the invention, showing radially arranged vertical retainers arranged for preventing the circumference of the tank bottom structure from being lifted from the tank supporting structure forming the bottom of the tank compartment.

So far, based on the above, the tank according to the invention may simplistically be described as being kept in place laterally through the use of a central hub in the bottom plate structure, and prevented from leaving the substructure or even toppling by means of vertical force retainers holding down the lower rim of the cylindrical tank wall towards the underlying tank support structure, as shown in FIG. 4. This will prevent damage to the tank due to roll, pitch, surge and gear movements of the ship, including action and reaction forces due to collision and grounding.

Figure 12A:
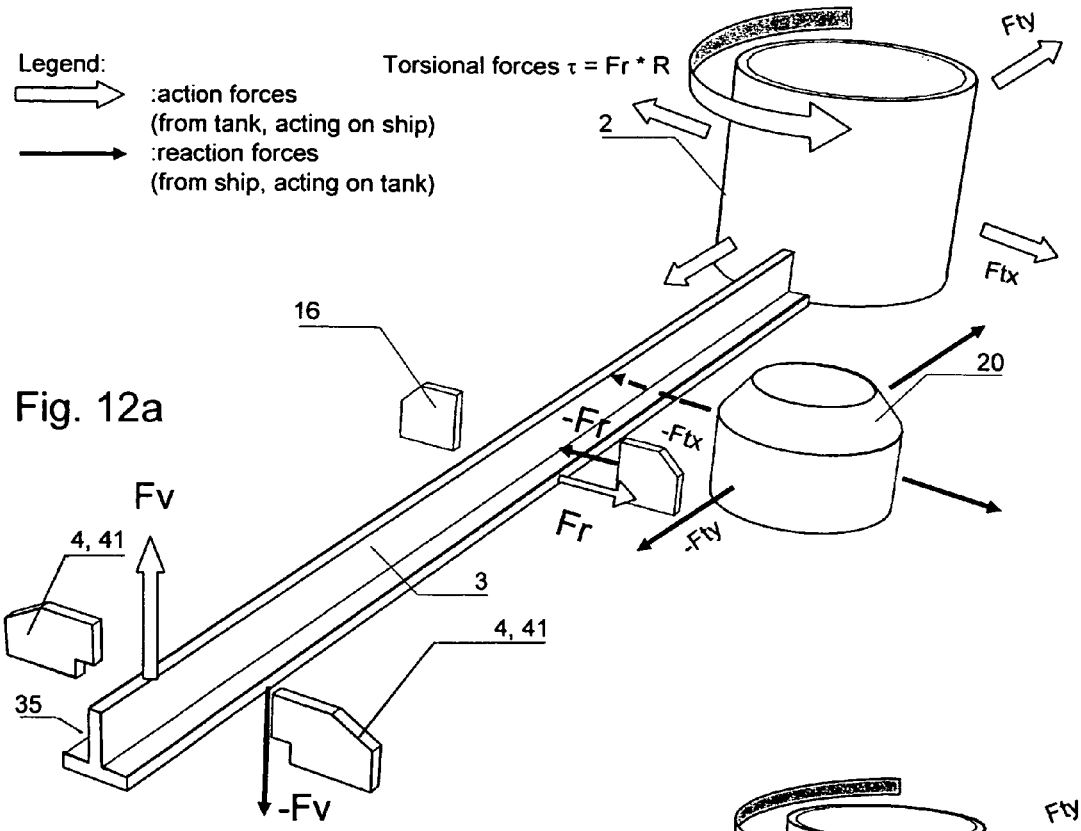
FIG. 12*a* and FIG. 12*b* are perspective illustrations of the action forces acting from the tank (white arrows), and the corresponding reaction forces from the tank support system. The central hub transmits forces acting along the beams of the tank bottom structure; the anti-rotational retainers transmit rotational moments; and the vertical retainers transmit vertical forces.
Figure 12B:
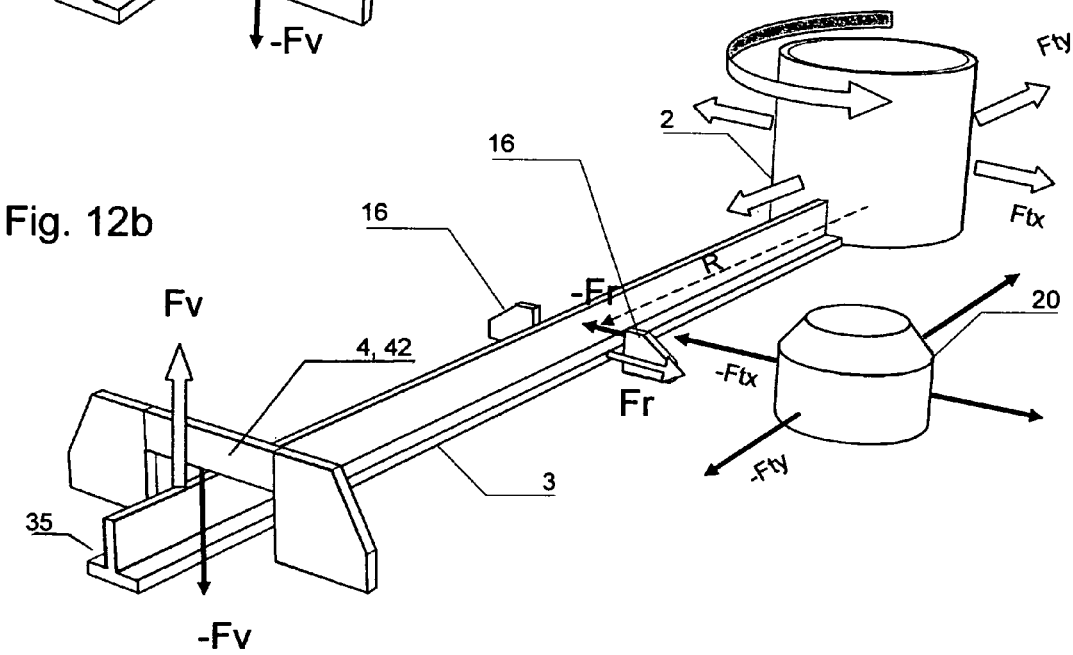

The particular design roughly illustrated in FIG. 9 will allow beam longitudinal motion due to radial thermal contraction of the beams (3) and may also be used for preventing undesired relative rotational movement of the tank bottom structure (10) relative to the underlying supporting substructure (23). Such rotational accelerations may arise both due to the ship's turning and also due to waves giving rise to yaw, i.e. a rotation of the ship about a vertical axis. Such rotational movements of the tank (1) relative to the ship may be counteracted through the application of anti-rotational retainers (16), please see FIG. 6, FIG. 10, (and FIGS. 11*a, b*, and *c*). The various forces acting upon a marine vessel are shown in FIG. 13. The counteracting forces as well as the principle of how the tank functions is shown in FIG. 12.

The anti-rotational retainers (16) comprise vertically arranged lateral retainer surface plates (17) extending parallel to the radial beams (3), said surface plates for resting against lateral surfaces of the radial beams (3), and having a bottom slide support (28) for vertically supporting the beam's (3) lower flange (14), which slide support (28) should further have thermal insulation properties.

Figure 6A:
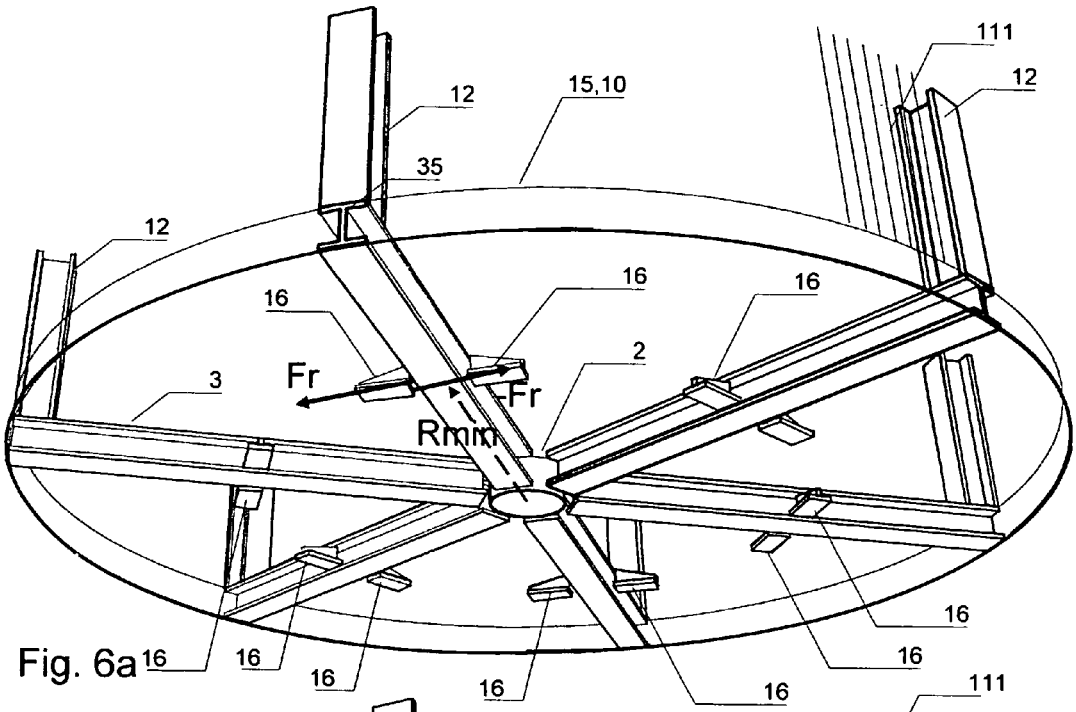
FIG. 6*a* is a perspective view from below the horizontal plane of an embodiment of a tank according to the invention with anti-rotational retainers for the radial beam structure of the tank. Here, the anti-rotational retainers are arranged approximately halfway radially from the cylindrical tank centre.

An advantage of the embodiment illustrated in FIG. 6*a* is that the anti-rotational retainers (16) are separate from the tank hub (2) and their roles are separate: the tank hub (2) to prevent any translational movement between the tank (1) and the hub retainer (20) on the structural tank support floor (23) of the ship, the anti-rotational retainers (16) are from preventing the tank to rotate relative to the ship. Such rotational forces may be induced by turning the ship, by intermittently turning the ship through yaw movements induced by sea waves, or through sloshing.

Figure 6B:
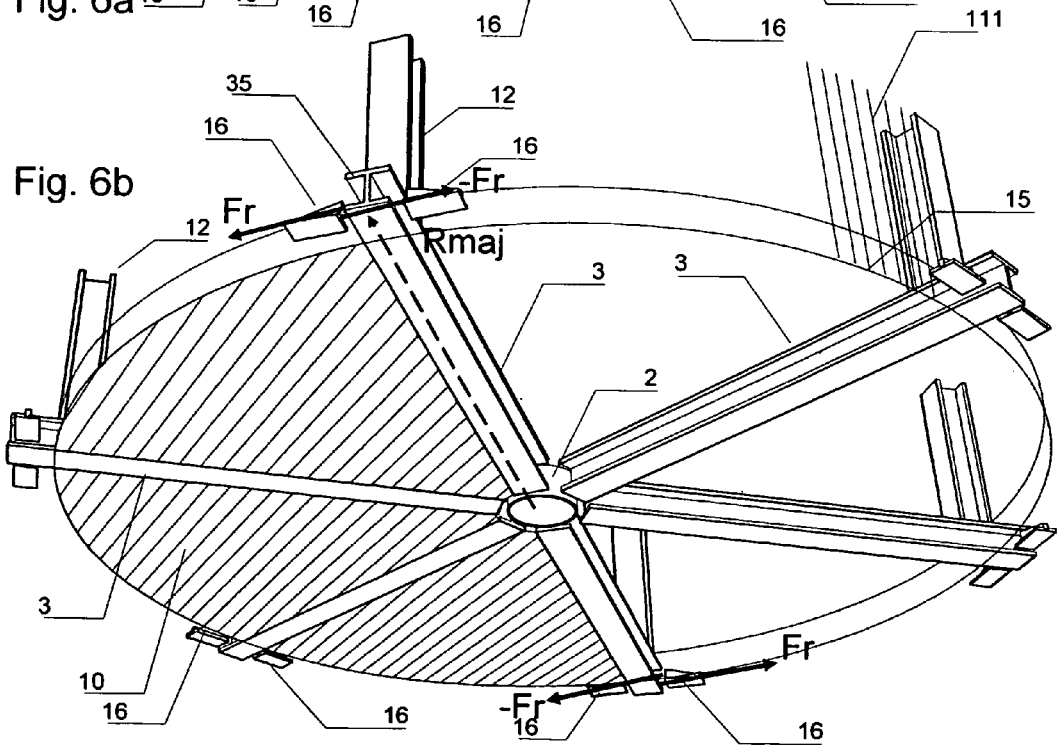
FIG. 6*b* is a similar perspective view from below the horizontal plane of another embodiment of a tank according to the invention with anti-rotational retainers arranged near the full beam length as counted radially from the cylindrical tank centre.

There is an advantage of the embodiment of the invention illustrated in FIG. 6*b*: the position of anti-rotational retainers (16) as shown in FIG. 6*a* may be moved to beyond the lower rim (15) of the tank bottom plate (13). The beam structure is internal, and thus the bottom plate may be arranged welded-in attached to the lower portions of the horizontal beams (3), thus leaving only the tank hub (2) forming a notch in the bottom plate.

Moreover, the anti-rotational retainers (16) arranged as in FIG. 6*b* provide two additional advantages: Firstly, they are arranged at a maximum radius of the tank, thus they provide the maximum anti-rotational moment available, and need not be designed as rigid as the ones illustrated in FIG. 6*a*, which provide almost half the anti-rotational moment; Secondly, they are arranged at points in the construction near the end of the beams, having more or less the same major radial distance (Rmaj) from the centre of the tank and directly below the tank wall (11) comprising the vertical beams (12), those presenting a large proportion of the tank's rotational moment. Thus the retainment of rotational moment through anti-rotational retainers (16) near the radial ends of the radial beams (3) as shown in FIG. 6*b* will induce less bending moment to the radial beams (3) than the arrangement of anti-rotational retainers (16) arranged in the minor radial distance (Rmin) near the middle of the radial beams (3) as shown in FIG. 6*a*. The same arguments are valid for the vertical retainers (4, 42) shown in FIG. 11*b*: They may withstand a larger rotational moment, particularly about the ship's longitudinal axis, when situated at a maximum radial distance from the tank bottom structure centre (i.e. the tank hub (2)) than for other tank support or retainer structures arranged nearer to the tank centre. Such vertical tank retainers as described in FIG. 11*b* thus will provide the same force moment on the tank as such as tank retainers arranged on either sides of the tank wall further up, but do not have the disadvantages of such retainers arranged further up on the wall, both mechanically and thermally considered.

In general, the arrangement of the anti-rotational retainers (16) positioned in a radial distance (Rmaj) beyond the tank wall (11) and the tank bottom (13) may provide a lower arranged tank bottom plate structure and thus a larger volume of the tank and a lowered gravity mass, and a better anti-rotational force moment than anti-rotational retainers arranged further in toward the central hub (2), and it also provides fewer structural penetrations of the insulation layer below the tank bottom. In general, the anti-rotational retainers (16) will constitute radially opposite pairs as shown in FIG. 6*b*, so no moment will be induced in the tank hub (2, 20). The inverted "U"-shape vertical retainers of FIG. 11*b* further provide lowering of the tank bottom liner plate (113) so as to render an internal structure bottom plate structure (10) and thus increasing the tank volume in the same manner as above.

FIG. 8 illustrates why there is a need for arranging the vertical retainers near the outer periphery of the tank such that the moment arm between vertical forces from the tank wall and retention vertical forces acting on the bottom structure become short. If the moment arm acting via the tank walls onto the tank bottom structure is undesiredly large, such as illustrated, there might occur failures in the tank bottom structure due to shear forces, with crack formation and possible leakage as result.

The above described tank according to the invention should have marine operational advantages. Thermal transfer may be kept low due to the fact that any support blocks or retainers are only required about the bottom plate of the tank, and no structural parts need cross the insulation layer in levels above the bottom plate of the tank, thus the insulation layer around the entire wall structure (11) may be continuous. This also simplifies the structural design of the cryogenic tank.

Additional logistic advantages arise from the fact that one or more tanks according to the invention as above described may be built simultaneously with the building of the ship provided with compartment recesses arranged for receiving the tanks according to the invention. A tank (1) according to the invention may be lowered into the recess, the central hub (2) for entering onto the hub retainer (20). The vertical force retainers (4) and possible anti-rotational retainers (16) may be prepared for receiving the radial beams (3) and may be completed by welding the arms (41) or inverted "U"-shaped bridles for embracing the radial beams (3).

As an alternative to using vertical force retainers (4) for embracing the outer portions of the radial beams (3), the bottom plate structure (10) and the beams (3) may be encompassed by a radially oriented rail (19) for being engaged by the vertical retainers (4). Such an arrangement may allow rotational relative movement of the cryogenic tank, a possible configuration being illustrated in FIG. 4.

According to an embodiment of the invention vertical retainers (4) may be arranged in the form of wedges (42) (illustrated in FIG. 4) arranged in the wall (24) of the tank compartment (25), the wedges (43) for being pivoted in and out of the compartment wall (24) for blocking the outer ends (35) of the beams (3) of the tank bottom structure (10) when the tank (1) is in place. Such wedges (42) may be controlled from the external space around the tank compartment (25), thus facilitating installation and removal of the tank in the ship. This may further reduce the requirements for space around the tank wall structure (11) and the periphery of the tank bottom structure (10) and improve the available tank volume of an internal structure tank to be lowered into a tank slot in a ship.

An advantage of the present invention is that the tank's central hub (2) is of small extent compared to the extent of the tank bottom structure (10). Thus the total thermal contraction or expansion of the central hub (2) will be relatively negligible during cooling or heating, compared to the extensive contraction or expansion incurred for the entire tank bottom structure compared to the compartment bottom when the tank is cooled or heated. The small extent of the tank hub (2) will allow that the tank hub may be retained in the single-point retainer (20) also when heated, which will allow the ship to sail with an empty tank, an operation which would not be possible with a cryogenic tank according to DE1781041.

The tank according to the invention thus solves some of the problems related to thermal contraction, lateral retaining, longitudinal retaining, sloshing load forces, distribution of rolling-induced forces, and stability of cryogenic tanks.

Normally, an internal tower is arranged in a cryogenic tank, the tower holding vertical pipes for filling and draining LNG or other fluids to and from the tank through the use of internal pumps and valves. Such other fluids may be Nitrogen, Carbon dioxide, LPG, and gas condensates. In an embodiment of the invention the bottom hub (2) and hub retainer (20) themselves may provide passages for an inlet and/or an outlet for cryogenic fluid, thus providing an easy manner by which the tank may be filled or emptied.

FIGS. 14*a* and 14*b* illustrate in a bottom view and an enlarged elevation view of embodiments of the invention showing enlarged peripheral vertical supports (4) arranged along the circumference of the tank for embracing the lower flanges of radial beams (3), which may render the previously described anti-rotational retainers (16) redundant as such. Such arrangements will be easier to manufacture, inspect, and install, and may allow a flat bottom of the tank compartment.

FIG. 15*a* illustrates a simplified vertical section through a tank bottom structure according to a preferred embodiment of the invention with a central hub (20) of a female type welded in between inner ends of radial beams (3), the central hub entered onto a male type central hub retainer (20) fixed in the framework of a supporting beam substructure (23) for holding the tank (1). An advantage of the female-type central hub (2) of FIG. 15*a* is that less bending moments are induced in the tank bottom structure (10) than for the alternative male-type central hub (2') illustrated in FIG. 15*b* below.

FIG. 15*b* illustrates a simplified vertical section through a tank bottom structure of an alternative embodiment of the invention, with a central hub (2') of a male type welded in between inner ends of radial beams (3), the central hub (2') entered into a central hub retainer (20') of the female type which is fixed in the framework of a supporting beam substructure (23) for holding the tank (1).

We claim:

1. A cryogenic tank (1) for liquefied gas with a planar tank bottom structure (10) supporting a tank wall structure (11), comprising a central single point hub (2) in said planar tank bottom structure (10), said central single point hub (2) having a substantially smaller diameter than a diameter of said tank bottom structure (10), said central single point hub (2) adapted for being retained by a corresponding hub retainer (20) on a tank support structural floor (23), said hub retainer (20) generally providing radially directed retention forces to said central single point hub (2) in the plane of said planar tank bottom structure (10) both when said cryogenic tank (1) is operating at cryogenic temperatures and when empty at ambient temperature.

2. The cryogenic tank (1) of claim 1, said central single point hub (2) coupled to radial structural beams (3) further arranged for supporting said tank wall structure (11).

3. The cryogenic tank (1) of claim 2, said radial beams (3) being prevented from vertical movement by vertical retainers (4).

4. The cryogenic tank (1) of claim 2, said tank wall structure (11) comprising girders (12) extending from near outer ends of said radial beams (3), said girders (12) directed generally parallel to a vertical tank axis (9).

5. The cryogenic tank (1) of claim 4, said beams (3) supporting a tank bottom liner (131).

6. The cryogenic tank (1) of claim 1, said tank wall structure (11) extending from and around a circumference (15) of said planar tank bottom structure (10), said tank wall structure (11) arranged for being retained from lifting by rolling and/or pitching movement away from said tank support structural floor (23) by vertical direction retainers (4) arranged on said tank support structural floor (23).

7. The cryogenic tank (1) of claim 3, wherein said vertical retainers (4) are further arranged for preventing rotational movement of said tank (1) about said central hub (2).

8. The cryogenic tank (1) of claim 1, being enveloped in a tank compartment (25) having a layer of insulation material (8, 18) arranged between said planar tank bottom structure (10) and said first compartment bottom (23), and arranged between said tank wall structure (11) and said compartment wall (24).

9. The cryogenic tank (1) of claim 1, said tank support structural floor (23) being within a tank compartment (25).

10. The cryogenic tank (1) of claim 1, said tank support structural floor (23) being arranged in a marine vessel (30).

11. The cryogenic tank (1) of claim 10, said tank support structural floor (23) being a deck of said marine vessel (30).

12. The cryogenic tank (1) of claim 10, said hub retainer (20) being fixed on a horizontally oriented ship tank support structural floor (23).

13. The cryogenic tank (1) of claim 11, said hub retainer (20) being fixed on a horizontally oriented ship tank support structural floor (23).

14. The cryogenic tank (1) of claim 1, said tank wall structure (11) being cylindrical, said planar tank bottom structure (10) generally forming a circular plane.

15. The cryogenic tank (1) of claim 1, said tank (1) being prismatic.

16. The cryogenic tank (1) of claim 1 arranged for containing LNG, LPG or any fluid having a low temperature.

17. The cryogenic tank (1) of claim 1, said planar tank bottom structure (10) being provided with a bottom liner plate (131) and said tank wall structure (11) provided with a wall liner plate (111).

18. A marine vessel for production and storage of LNG comprising a cryogenic tank (1) for said LNG, with a planar tank bottom structure (10) supporting a tank wall structure (11), characterised in that said planar tank bottom structure (10) has a central single point hub (2) coupled to radial structural beams (3) further arranged for supporting said tank wall structure (11), said central single point hub (2) having a substantially smaller diameter than a diameter of said tank bottom structure (10), said central single point hub (2) adapted for being held by a corresponding hub retainer (20) on a tank support structural floor (23) in said ship, said hub retainer (20) generally providing radially directed retention forces to said central single point hub (2) in the plane of said planar tank bottom structure (10) both when said cryogenic tank (1) is operating at cryogenic temperatures and when empty at ambient temperature.

19. A marine vessel for storage and regasification of LNG comprising a cryogenic tank (1) for said LNG, with a planar tank bottom structure (10) and a tank wall structure (11) arranged on said planar tank bottom structure (10), characterised in that said planar tank bottom structure (10) has a central single point hub (2) coupled to radial structural beams (3) further arranged for supporting said tank wall structure (11), said central single point hub (2) having a substantially smaller diameter than a diameter of said tank bottom structure (10), said central single point hub (2) adapted for being held by a corresponding hub retainer (20) on a tank support structural floor (23) in a ship, said hub retainer (20) generally providing radially directed retention forces to said central single point hub (2) in the plane of said planar tank bottom structure (10) both when said cryogenic tank (1) is operating at cryogenic temperatures and when empty at ambient temperature.

20. A ship for transportation of LNG comprising a tank (1) for said LNG, with a generally vertical tank axis (9) and a planar tank bottom structure (10) and a tank wall structure (11) arranged on said planar tank bottom structure (10), characterised in that said planar tank bottom structure (10) has a central single point hub (2) coupled to radial structural beams (3) further arranged for supporting said tank wall structure (11), said central single point hub (2) having a substantially smaller diameter than a diameter of said tank bottom structure (10), said central single point hub (2) adapted for being held by a corresponding hub retainer (20) on a tank support structural floor (23) in said ship, said hub retainer (20) generally providing radially directed retention forces to said central single point hub (2) in the plane of said planar tank bottom structure (10) both when said cryogenic tank (1) is operating at cryogenic temperatures and when empty at ambient temperature.

21. The tank (1) according to claim 1, wherein said hub retainer (20) is arranged with one or more channels for filling or emptying the tank with cryogenic fluid.

22. A method of installing a cryogenic tank (1) for liquefied gases in a vessel wherein said tank (1) comprises a planar tank bottom structure (10) and a tank wall structure (11) on a circumference of said planar tank bottom structure (10), wherein said planar tank bottom structure (10) is provided with a generally central tank bottom hub (2) adapted for being held by a bottom hub retainer (20) on a tank support structural floor (23), said central tank bottom hub (2) having a substantially smaller diameter than a diameter of said tank bottom structure (10), wherein said method comprises hoisting the tank (1) and lowering said tank (1) directly onto said bottom hub retainer (20), with a remainder of the tank bottom structure (10) supported on insulation (8) provided between the remainder of tank bottom structure (10) and the tank support structural floor (23).

* * * * *